United States Patent [19]

Morello

[11] 4,454,570

[45] Jun. 12, 1984

[54] MULTIPLE COLORED SEARCHLIGHT SIGNAL UNIT

[75] Inventor: Giovanni Morello, Turin, Italy

[73] Assignee: WABCO Westinghouse Compagnia Italiana Segnali S.p.A., Turin, Italy

[21] Appl. No.: 354,843

[22] Filed: Mar. 4, 1982

[30] Foreign Application Priority Data

Mar. 9, 1981 [IT] Italy ..... 67328 A/81

[51] Int. Cl.[3] ..... F21V 9/00

[52] U.S. Cl. ..... 362/231; 362/293; 362/297; 362/299; 362/300; 362/301; 362/308; 362/375

[58] Field of Search ..... 362/231, 293, 297, 299, 362/300, 301, 308, 375

[56] References Cited

U.S. PATENT DOCUMENTS 4,120,026 10/1978 Tsuchihashi et al. ..... 362/231

4,291,365 9/1981 Tandon et al. ..... 362/293

4,353,110 10/1982 Ellis ..... 362/231

4,367,514 1/1983 Large et al. ..... 362/293

*Primary Examiner*—Stephen J. Lechert, Jr.

*Attorney, Agent, or Firm*—J. B. Sotak

[57] ABSTRACT

A searchlight signaling device including a housing in which is mounted an optical system for producing colored signal lights. The optical system includes an objective lens for projecting the colored signal lights through an aperture formed in the housing. A plurality of white light sources and elliptical reflectors for conveying light rays through associated colored filters for producing different color light rays. A plurality of dichroic mirrors angularly disposed in relation to the focal axis of the objective lens for intercepting the color light rays. The dichroic mirrors transmit certain color light rays and reflect other color light rays so that a given colored signal light is emitted through the aperture.

10 Claims, 4 Drawing Figures

MULTIPLE COLORED SEARCHLIGHT SIGNAL UNIT

FIELD OF THE INVENTION

This invention relates to a multiple color aspect signal unit, and more particularly to a searchlight signaling device, especially for railway signaling, which is capable of selectively providing luminous radiation of an initial color or one of a plurality of subsequent colors which have correspondingly higher frequency bands than the frequency band of the corresponding initial color. The signal device includes a metal weatherproof casing for housing the optical assembly. The housing includes a frontal opening which is covered by a plano-convex lens. The optical assembly includes a plurality of lamps for the generation of luminous radiation. A static color filtering system is interposed between the lens and the lamps. The color filtering system is capable of determining statically the chromatic characteristics of the light emerging from the plano-convex lens in the front of the housing.

In certain known colored signaling devices or serachlight signaling units, the means for the generation of luminous radiation includes a single lamp. The lamp is capable of generating white or achromatic light which is focused at the focal point of the plano-convex lens by a polished reflector. In these known devices, the optical filtering system includes a movable screen which is disposed between the lens and the source of white light. The mobile screen is equipped with a given number of different colored filters or roundels. Each of the colored roundels is selectively interposed between the source of white light and the lens. The position of the mobile screen is achieved by means of a motor or relay drive mechanism which is also located within the housing. These previous signal devices must rely upon the transitional displacement by a mechanical device which is a distinct disadvantage. That is, in order to ensure correct operation and power signal display, it is assumed the dive mechanism is functioning properly. Thus, the correct positioning of the mobile screen which carries the colored filters is dependent upon the proper operation of the drive mechanism. Ergo, a breakdown or malfunction of the drive mechanism may result in a filter of the wrong color being positioned between the source of white light and the objective lens. The resulting consequence of such a failure in the moving parts of these previous signal devices may cause an erroneous less restrictive signal display.

OBJECTS OF THE INVENTION

Accordingly, it is an object of the present invention to provide a new and improved railway searchlight signaling device which is free of the disadvantages of previous known signaling devices.

A further object of this invention is to provide a novel multiple color signal unit having a high degree of reliability.

Another object of this present invention relates to a light signal device for searchlight signaling, especially for a railway signal, capable of providing luminous radiation with an initial color and with a number of subsequent colors, which have frequency bands higher than the frequency band corresponding to the initial color. The device includes a support housing, a plano-convex lens installed in proximity to an opening in the housing. The means for generating luminous radiation is located inside the housing. An optical filtering system is interposed between the lens and the luminous generating means. The optical filtering system determines the chromatic characteristics of the light emerging from the opening of the housing through the lens. The optical filtering system includes $(N+1)$ number of different colored filters and N number of dichroic mirrors where $N \geqq 1$. The dichroic mirrors being capable of reflecting the radiation energy having frequencies equal to or greater than the frequencies of the color passed by the associated colored filter and to transmit the rays having lower frequencies. The dichroic mirrors being arranged in fixed positions between the plano-convex lens and its focal point so that in looking from the focal point of the lens to the lens itself, the cut-off frequency of each dichroic mirror is less than or equal to that of the following dichroic mirror and greater than or equal to that of the preceding dichroic mirror. The means for generating the luminous radiation include a first source of light which is capable of being focused on the focal point of the lens a luminous radiation having the initial color, and N number of other sources of light, each capable of producing a luminous radiation, having a respective color of the N number of colors, at the point representing the virtual image of the focal point of the lens with respect to the dichroic mirror associated with the given color.

DESCRIPTION OF THE DRAWINGS

These objects and other attendant characteristics and advantages of the present invention will become more readily apparent when taken in conjunction with the following detailed description which makes reference to the attached drawings and are given merely by way of example and are not limiting in nature, in which.

Figure 1:
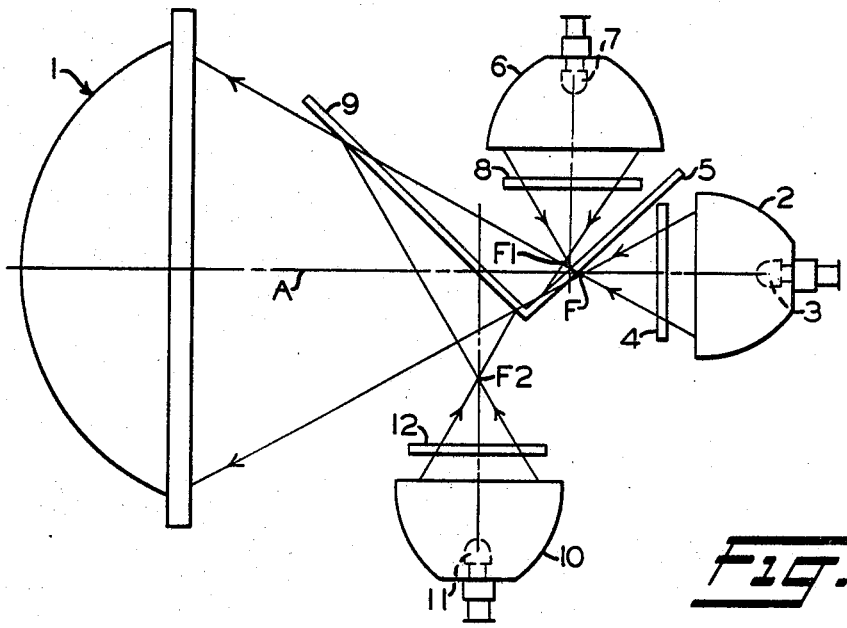
FIG. 1 is a schematic diagrammatic view of one form of, for example, an optical system for the signaling device of the present invention.

Referring now to the drawings and in particular to FIG. 1, there is shown a plano-convex lens 1, the focal axis of which is indicated by the character A. The objective lens 1 is preferably clear or colorless. A first elliptical dichroic reflector 2, consisting for example of a partially-silvered mirror, is arranged with the longer axis lying on the focal axis A of the lens 1. A source of white light, such as an electric lamp, 3 is located in a first focus of the reflector 2. The light source consists preferably of a halogen lamp. The focal point F of the reflector 2 coincides with focal point of the plano-convex lens 1. A red colored dichroid filter 4 is located between the elliptical mirror 2 and the focus F of the projector lens 1. Thus the luminous rays which are generated by the lamp 3 and are reflected by the silvered reflector 2 will cross at the focal point F. The filter 4 may consist of a plastic or composite lens.

As shown, a red dichroic filter or semitransparent mirror 5 is located between the focus F of the lens 1 and the lens 1, itself. It will be seen that the dichroic mirror 5 is disposed in a plane forming a 45° angle with the focal axis A of the plano-convex lens 1. The red dichroic filter 5 is capable of transmitting light rays of a red color and of reflecting the light rays having higher frequencies than red light. In viewing FIG. 1, it will be noted that a second ellipitcal dichroic reflector or partially-silvered mirror 6 is located above the focal axis A of lens 1. A source of white light 7, also consisting preferably of a halogen lamp, is located at the first focus of the elliptical mirror 6. The other focus of the reflector 6 coincides with the point $F_1$ representing the virtual image of the focus F of the lens 1, with respect to the red dichroic mirror 5. Thus, the major axis of the elliptical reflector 6 is perpendicular to the focal axis A of the lens 1. A yellow dichroic colored glass filter 8 is disposed between the reflector 6 and the point $F_1$. Accordingly, the light rays generated by the lamp 7 and reflected by the reflector 6 will cross at the focal point $F_1$.

As shown, a yellow dichroic filter of semitransparent mirror 9 is located between the red dichroic mirror 5 and the plano-convex lens 1. Thus, all the yellow light rays emanating from the focus $F_1$ are reflected by the dichroic mirror 5 and pass through mirror 9 to reach the plane surface of the plano-convex lens 1. The yellow dichroic mirror or filter 9 is disposed in a plane forming an angle of 90° with the plane containing the red dichroic mirror 5. As is well known, the yellow dichroic mirror 9 is capable of transmitting light rays of a yellow color or colors having frequencies lower than yellow light and is adopted to reflect any light rays having frequencies higher than that of yellow light.

In viewing FIG. 1, it will be seen that a third elliptical dichroic relfector or mirror 10 is located below the focal axis A of lens 1. As shown, a source of white light 11, also preferably consisting of a halogen lamp is located at the first focal point of the elliptical mirror 10. The other focus of the reflector 10 coincides with a focal point $F_2$ representing the virtual image of the focus F of the lens 1, with respect to the yellow dichroic mirror 9. It will be noted that the major axis of the elliptical dichroic reflector 10 is situated perpendicular to the focal axis A of the plano-convex lens 1. A green dichroic colored glass filter 12, for example, a plastic type of filter lens which is interposed between the reflector 10 and the yellow dichroic so as to intercept the light rays which are generated by the light source 11 and which are reflected by the reflector mirror 10.

The use of dichroic filters and reflectors reduces the heating effects of the infrared light rays which are produced by the white light sources.

Now let us assume that an electrical current is only fed to the halogen lamp 3 so that the light generated by it is reflected by the reflector 2. The reflected white light is colored red by the glass filter 4. This red colored light traverses or passes through the dichroic mirror 5, the dichroic mirror 9, and impinges upon the plane face of the plano-convex lens 1. Thus, the objective lens 1 correspondingly emits a beam of red light from its convex face. In railway operations, a red signal light indicates an ensuing danger condition.

Now if an electrical current is only fed to the halogen lamp 7, the emitted white light from this lamp is reflected by the reflector 6. The white light passes through the colored plastic filter 8 and assumes a yellow coloration. This yellow light strikes the red dichoric filter 5, which, for the yellow rays, acts like a mirror. The yellow rays are reflected and strike the yellow dichroic mirror 9, which transmits them to the plane face of the plano-convex lens 1. Thus, the convex surface of lens 1 emits a beam of yellow light which signifies a caution to oncoming traffic.

Finally, if an electrical current is only fed to the halogen lamp 11, the white light emitted by this lamp is reflected by the mirrored reflector 10. The white light passes through the green filter and emerges as a green light. The green light strikes the yellow dichroic filter 9 which, for green rays, acts like a mirror. The green ray is then reflected onto the plane face of the plano-convex lens 1, and emerges from the convex face of the objective lens 1. The emerging green light signals a clear or safe condition.

Figure 2:
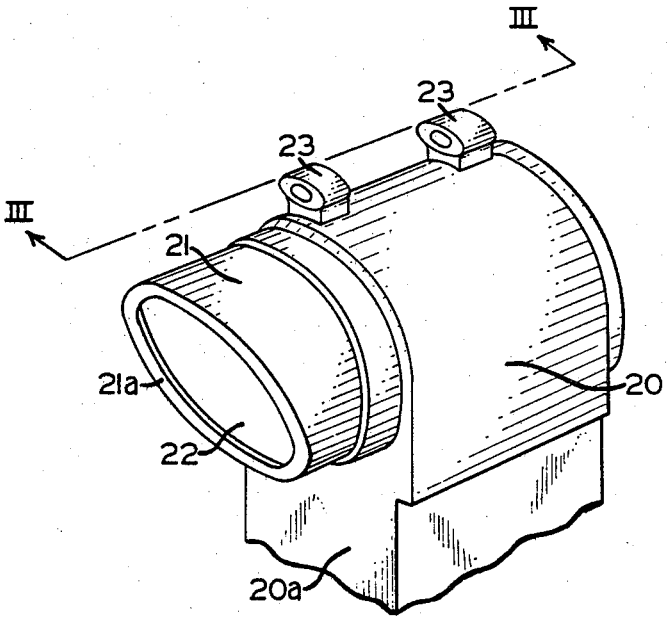
FIG. 2 is a perspective view of a signaling device according to the invention.
Figure 3:
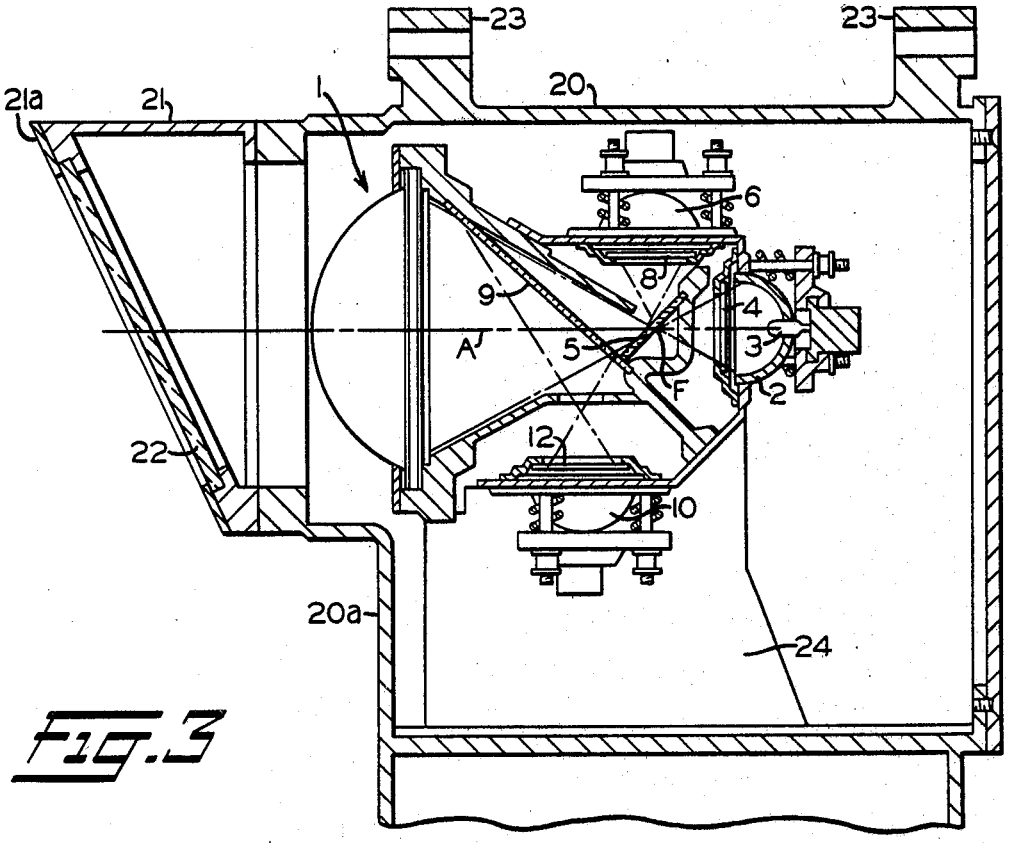
FIG. 3 is a cross section, enlarged, along lines III-III of FIG. 2.

A three color aspect searchlight signal device of this invention as described with reference to the schematic diagram of FIG. 1 can be physically constructed to take the form as illustrated in FIGS. 2 and 3. As shown in FIGS. 2 and 3, the light unit is mounted with a rigid protective housing or case 20. The upper front end **20*a* of housing 20 is provided with a cylindrical tubular lens barrel to which is secured the hood 21 which shields the lens 1 from the direct rays of the sun or the lights of oncoming vehicles. The forward open end 21*a* of the cylindrical barrel section 21 is inclined or slanted downwardly to minimize the effects of sunlight. A clear transparent cover plate or diffuser 22 is secured to the open end 21*a* of the tubular hood 21**.

As shown, the top of the signal housing 20 is provided with a pair of apertured sighting members 23 which are aligned coaxially so as to be usable for the alignment or correct positioning of the signaling device.

In viewing FIG. 3, it will be seen that the inside of the housing 20 supports a frame member 24 which carries the optical system of the light sources as described in the schematic diagram of FIG. 1.

The lamps 3, 7 and 11 are electrically connected to a suitable source of power by a conventional type of control and operating system (not shown).

The searchlight signaling device according to the present invention operates with intrinsic reliability. For example, if for any reason the yellow dichroic mirror 9 breaks, the signal device is no longer capable of providing the safe green signal. However, the signal device is still capable of producing the yellow and red signals which is indicative of a caution condition and an order to stop, respectively. In the railroad industry, the absence of a signal or a dark signal is synonymous to a dangerous red signal which signifies an order to stop.

Now, if the red dichroic mirror 5 is damaged, then only the yellow caution signal is incapable of being conveyed to a passing train. The red signal, normally associated with more restrictive conditions and orders, is still capable of being produced.

While highly unlikely, it is quite possible that both of the dichroic mirrors 5 and 9 may become broken or may be seriously deteriorated by water leakage or the like. Under this condition both the green signals or the yellow signals will be incapable of being emitted, but it will be possible to cast the red signal.

The chromatic characteristics of the three different color signals put out by the signaling device described can be modified by changing the composition of the condensing or converging filters 4, 8 and 12. Further, in place of the yellow dichroic mirror 9, an orange dichroic mirror can be substituted. In this case, the green color signal put out by the signaling device will be more intensely green, and less bluish. In addition, the yellow light produced by the signalling device will have fewer green components and more red components.

It will be appreciated that by changing the composition of the filters 4, 8 and 12, and by appropriately selecting the colors of the dichroic mirrors 5 and 9, it is possible to produce colored signals which have chromatic characteristics satisfactory for standard requirements, for example, of the administrations of the railway systems of most any country.

Figure 4:
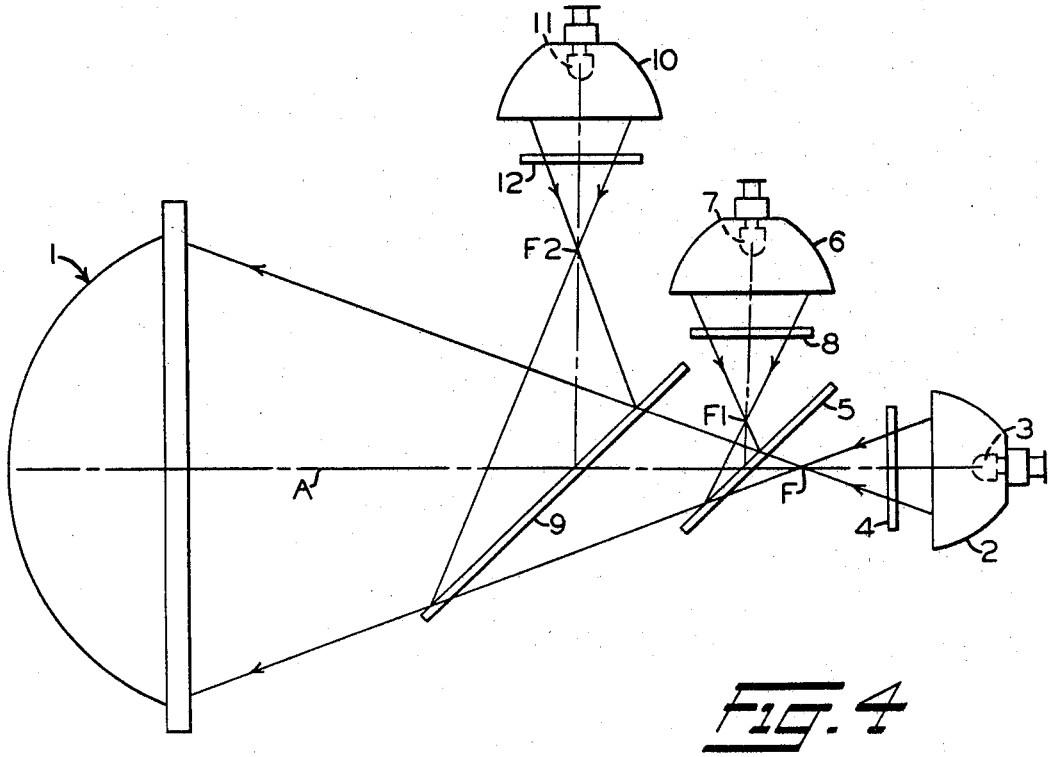
FIG. 4 illustrates a variant of the schematic diagram of FIG. 1.

Let us now refer to FIG. 4 which shows a schematic diagram of another embodiment of the optical system which is slightly different from that illustrated in FIG. 1. In this embodiment, the dichroic mirror 9, which may be either yellow or orange, is placed in a plane which is parallel to the plane of the dichroic mirror 5. The lamp 11, its associated elliptical reflector 10, and the green filter 12 are therefore located on the same side as the lamp 7, its associated elliptical reflector 6, and the yellow filter 8, namely with respect to the focal axis A of the plano-convex lens 1. The mode of operation of the system illustrated in FIG. 4 is substantially the same as the mode of operation of the optical system in FIG. 1, and therefore need not be described in further detail.

The optical schematic diagrams shown in FIGS. 1 and 4 may be modified in such a manner that the searchlight signaling device is capable of giving luminous signals in other colors. If, for example, it is desirable to have a four aspect signaling device which is capable of providing light rays having the colors of red, yellow, green, and violet, it is simply necessary to add a green dichroic filter to the optical system in FIG. 1. The dichroic mirror is placed in a plane which is parallel to the plane of the red dichroic mirror 5 and is positioned between the yellow dichroic filter 9 and the plano-convex lens 1. It is also necessary to pre-arrange a source of violet light at the point representing the virtual image of the focus F of the lens 1, with respect to the light yellow dichroic filter. This source of violet light can consist of a source of white light, an elliptical reflector and a violet colored filter. Similarly, the same result can be achieved by adding to the optical system illustrated in FIG. 4. That is, another light yellow dichoric filter can be arranged parallel to the dichroic filters 5 and 9. This added yellow dichoric filter is positioned between the dichroic filter 9 and the plano-convex lens 1. In this case, too, it is necessary to provide a source of violet light at the point representing the virtual image of the focus F of the lens 1, with respect to the green dichroic filter. Conversely, a two aspect signaling device may be realized by removing either mirror 5 or 9 along with its associated source of white light, reflector and filter.

From the above-described explanation, it is apparent that the structure of the searchlight signaling device according to the invention can be subsequently expanded to produce signaling devices capable of supplying light rays with a primary or one color and with N ($N \geqq 1$) of a secondary or other color. It will be understood that the frequencies of the secondary colors are higher than the frequency corresponding to the primary color. The signaling device includes a protective case for housing an N number of dichroic mirrors which are arranged between the focus F of the plano-convex lens and the lens 1, itself. In looking from the focus F to the lens 1, the filtering frequency of each dichroic mirror is less than or equal to that of the preceding dichroic mirror. A first light source is adapted to produce at the focus F of the lens 1, light rays of the abovementioned primary color. An N number of other light sources, each of which is capable of producing light rays at the point representing the virtual image of the focus F of the lens 1 with respect to a corresponding dichroic mirror.

The light sources may be selectively located on one side of the focal axis A of the plano-convex lens, or alternately, may be disposed on opposite sides of the focal axis A.

Naturally, as long as the principle of the invention remains the same, the forms and the details of the equipment may differ extensively from what has been described and illustrated purely by way of non-limiting examples, without, however; going beyond the scope of the present invention.

Having now described my invention, what I claim as new and desire to secure by Letters Patent is:

1. A multiple colored aspect signal unit for providing light rays with a primary color and with N number of secondary colors where $N \geqq 1$, said N number of secondary colors having frequency bands higher than the frequency band of the primary color comprising, a support housing, a lens located in proximity of an aperture in said housing, means for generating light rays located inside the housing, an optical filtering system, interposed between said lens and said generating means, said optical filtering system determines the chromatic characteristics of the light emerging from the aperture of the housing through the lens, said optical filtering system including N number of dichroic mirrors each of which is associated with a respective color of said N number of secondary colors, each of said dichroic mirrors reflecting the light rays having frequencies equal to or greater than the frequencies of the band of color with which the filter is associated and transmitting the light rays having lower frequencies, said dichroic mirrors being arranged in fixed positions between said lens and the focus of the lens, so that, proceeding from the focus of the lens to the lens, the filtering frequency of each of said dichroic mirrors is less than or equal to that of the following dichroic mirror and greater than or equal to that of the preceding dichroic mirror, and means for generating light rays which include a first luminous source for producing the focus of the lens a light ray having said primary color, and which include N number of other light sources for producing light rays having a respective color of said N number of secondary colors at the point representing the virtual image of the focus of the lens with respect to said dichroic mirror associated with the color.

2. The multiple colored aspect signal unit as defined in claim 1, wherein said primary light source produces red light rays at the focus of said lens.

3. The multiple colored aspect signal unit as defined in claim 2, wherein said N number of secondary colors include yellow and green rays, said optical filtering system includes a red dichroic mirror interposed between said lens and the focus of said lens, a source of yellow light produces a beam of yellow light at the point representing the virtual image of the focus of said lens with respect to said red dichroic mirror, a yellow dichroic mirror interposed between said first red dichroic mirror and said lens, a source of green light produces a beam of green light at the point representing the virtual image of the focus of said lens with respect to said yellow dichroic mirror.

4. The multiple colored aspect signal unit as defined in claim 1, wherein light rays include a first source of white light located at a first focus of first elliptical reflector, the second focus of which coincides with the focus of said lens, at least a second source of white light located at the first focus of at least a second elliptical reflector, the second focus of which is at the point representing the virtual image of the focus of said lens with respect to at least one of said dichroic mirrors and a colored filter being interposed between the said second focus of each of said elliptical reflector and each of said elliptical reflectors.

5. The multiple colored aspect signal unit as defined in claim 4, each of said sources of white light is a halogen lamp.

6. The multiple colored aspect signal unit as defined in claim 4, wherein each of said colored filters is a composite optical filter.

7. The multiple colored aspect signal unit as defined in claim 6, each of said elliptical reflectors is a dichroic elliptical mirror.

8. The multiple colored aspect signal unit as defined in claim 3, said red and yellow dichroic filters lie in planes which are perpendicular to one another, and each forming an angle of 45° with the focal axis of said plano-convex lens.

9. A colored signal device comprising, a casing having an opening, an optical system mounted within said casing, said optical system including a lens, a plurality of white light sources, a plurality of colored filters and a plurality of dichroic mirrors, said lens having its focal axis disposed in line with said opening to permit the emission of colored signals, each of said plurality of white light sources including a lamp and an elliptical reflector, one of said plurality of colored filters disposed in front of each one of said elliptical filters for producing different color rays, said plurality of dichoric mirrors disposed on a 45° angle relative to the focal axis of said lens so that certain color rays are transmitted through said plurality of dichoric mirrors so that certain other color rays are reflected by said plurality of dichroic mirrors so that a given color signal is emitted through said opening.

10. The multiple colored aspect signal unit as defined in claim 1, wherein said lens is a plano-convex lens.

* * * * *